US007498510B2

(12) United States Patent
Chen et al.

(10) Patent No.: US 7,498,510 B2
(45) Date of Patent: Mar. 3, 2009

(54) CONDUCTIVE CLOSURE ARRANGEMENT

(75) Inventors: Kang-Sheng Chen, Taipei (TW); Wu-I Chu, Taipei (TW)

(73) Assignee: Fabric King Texile Co., Ltd., Taipei (TW)

( * ) Notice: Subject to any disclaimer, the term of this patent is extended or adjusted under 35 U.S.C. 154(b) by 180 days.

(21) Appl. No.: 11/427,653

(22) Filed: Jun. 29, 2006

(65) Prior Publication Data

US 2008/0029288 A1 Feb. 7, 2008

(51) Int. Cl.
*H01B 11/06* (2006.01)

(52) U.S. Cl. ..... 174/36; 174/DIG. 11

(58) Field of Classification Search ..... 174/36, 174/110 R, 112, 113 R, 115, DIG. 11
See application file for complete search history.

(56) References Cited

U.S. PATENT DOCUMENTS 4,869,683 A * 9/1989 Nelson ..... 439/369
5,357,049 A * 10/1994 Plummer, III ..... 174/36
5,391,838 A * 2/1995 Plummer, III ..... 174/36
5,611,085 A * 3/1997 Rasmussen ..... 2/102
5,757,929 A * 5/1998 Wang et al. ..... 381/300
5,861,579 A * 1/1999 Bickersteth et al. ..... 174/136
5,949,026 A * 9/1999 DeFlorio ..... 174/117 R
6,324,053 B1 * 11/2001 Kamijo ..... 361/683
6,443,347 B1 * 9/2002 Elizalde et al. ..... 224/626
6,507,486 B2 * 1/2003 Peterson, III ..... 361/683
6,826,782 B2 * 12/2004 Jordan ..... 2/94
2005/0069147 A1 * 3/2005 Pedersen ..... 381/74

* cited by examiner

*Primary Examiner*—William H Mayo, III

(57) ABSTRACT

A closure arrangement includes two opposite bodies and a slider. Each of the bodies has a cooperative structure such as teeth of a zipper for the slider coupling and uncoupling the cooperative structure. A conductive conduit is provided within the bodies respectively. Each of the bodies has an upper stop with a connector inside for the upper ends of conductive conduits being coupled to a pair of external conductive conduits. A common bottom stop is joined to the bottoms of the bodies with two connectors inside the common bottom stop for the lower ends of the conductive conduits being coupled to another pair of external conductive conduits.

13 Claims, 4 Drawing Sheets

CONDUCTIVE CLOSURE ARRANGEMENT

TECHNICAL FIELD

Embodiments of the present invention relate to the field of closure arrangements, and more particularly, to a closure arrangement that includes at least one conductive conduit.

BACKGROUND

Portable electronic devices such as, for example, audio players, video players, personal digital assistants, cell phones, digital cameras, games, etc. are very popular. These devices require power, which may be obtained through, for example, batteries that may be rechargeable or direct power sources. Additionally, often users will want to listen to sound from the devices through head sets or ear pieces. However, direct power sources, battery chargers, head sets and ear pieces often use one or more lines to couple to the device. These lines may become tangled and/or unwieldy.

BRIEF DESCRIPTION OF THE DRAWINGS

Embodiments of the present invention will be readily understood by the following detailed description in conjunction with the accompanying drawings. To facilitate this description, like reference numerals designate like structural elements. Embodiments of the invention are illustrated by way of example and not by way of limitation in the figures of the accompanying drawings.

DETAILED DESCRIPTION OF EMBODIMENTS OF THE INVENTION

In the following detailed description, reference is made to the accompanying drawings which form a part hereof wherein like numerals designate like parts throughout, and in which is shown by way of illustration embodiments in which the invention may be practiced. It is to be understood that other embodiments may be utilized and structural or logical changes may be made without departing from the scope of the present invention. Therefore, the following detailed description is not to be taken in a limiting sense, and the scope of embodiments in accordance with the present invention is defined by the appended claims and their equivalents.

Various operations may be described as multiple discrete operations in turn, in a manner that may be helpful in understanding embodiments of the present invention; however, the order of description should not be construed to imply that these operations are order dependent.

The description may use perspective-based descriptions such as up/down, back/front, and top/bottom. Such descriptions are merely used to facilitate the discussion and are not intended to restrict the application of embodiments of the present invention.

For the purposes of the present invention, the phrase "A/B" means A or B. For the purposes of the present invention, the phrase "A and/or B" means "(A), (B), or (A and B)". For the purposes of the present invention, the phrase "at least one of A, B, and C" means "(A), (B), (C), (A and B), (A and C), (B and C), or (A, B and C)". For the purposes of the present invention, the phrase "(A)B" means "(B) or (AB)" that is, A is an optional element.

The description may use the phrases "in an embodiment," or "in embodiments," which may each refer to one or more of the same or different embodiments. Furthermore, the terms "comprising," "including," "having," and the like, as used with respect to embodiments of the present invention, are synonymous.

Embodiments of the present invention provide a closure arrangement that includes at least one conductive conduit.

Figure 1:
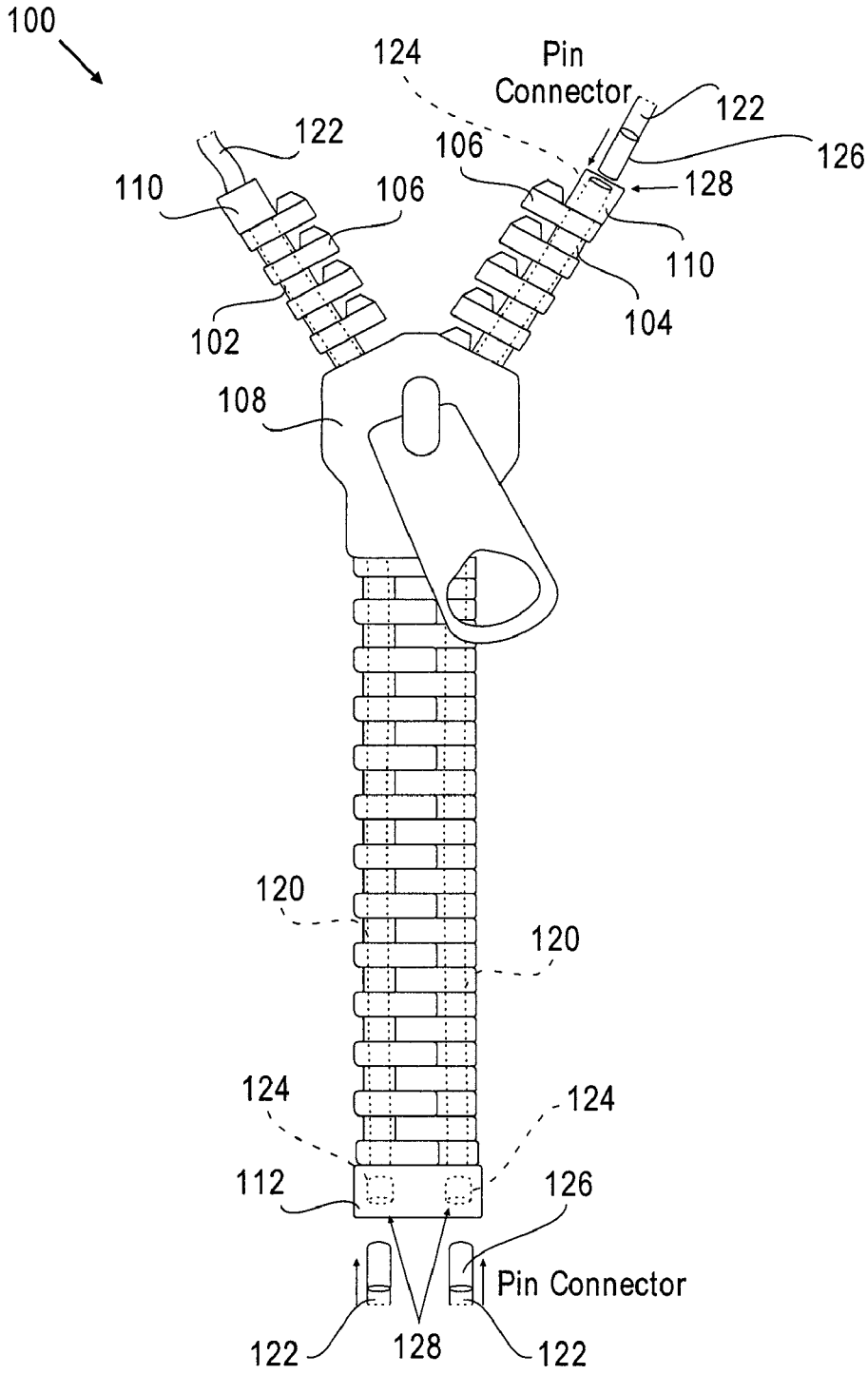
FIG. 1 illustrates a closure arrangement in accordance with various embodiments of the present invention.

Referring to FIG. 1, a closure arrangement 100 in accordance with various embodiments is illustrated. While the arrangement is illustrated as a loop/slide-type zipper, those skilled in the art will understand that other types of closure arrangements may be used in accordance with the teachings of the present invention. Examples may include, but are not limited to, hook and loop arrangements, button arrangements, snap arrangements and Ziploc-type arrangements.

As may be seen in FIG. 1, the closure arrangement may include two opposing bodies 102, 104. Each body includes cooperative mating structure 106. In this example of a zipper, the cooperative mating structure 106 is in the form of teeth. Slider 108 may be used to couple and uncouple the teeth to thereby close and open the closure arrangement.

Each body 102, 104 may includes an upper stop 110. Each body also includes a lower or bottom stop similar to upper stops 110, or a common bottom stop 112 may be provided to which each body is coupled. In various embodiments of the present invention, the zipper, or other types of closure arrangements, may be coupled to apparatuses, such as, for example, garments or bags to close a portion of the apparatus.

In accordance with various embodiments of the present invention, a conductive conduit 120 may be provided within and/or coupled to each body 102, 104. Those skilled in the art will understand that only one body may include one or more conductive conduits depending upon the design of the closure arrangement 100, or that each body may include more than one conductive conduit depending on the design of the closure arrangement. An example of a conductive conduit includes, but is not limited to, a conductive metal wire coated with a suitable insulating material such as, for example, Polytetrafluoroethylene (PTFE), a carbon fiber wire with a suitable insulating material, or an optical fiber.

In accordance with various embodiments of the present invention, connectors 124 may be provided within stops 110, 112 and may be operatively coupled to the conductive conduits 120. The connectors 124 may allow for external conductive conduits 122 to be operatively coupled to the conductive conduits 120 within the bodies 102, 104 via cooperative connectors 126. The external conductive conduits 122 may be operatively coupled to, for example, a power source, a battery charger, a personal electronic device and audio producing devices such as speakers, head sets and ear pieces. Conductive conduits 120 may also extend through stops 110, 112 and include connectors coupled to their ends. An example of a cooperative connector structure may include, but is not limited to a male/female connector structure such as a pin 126 and a mating hole 128 in connectors 124.

Figure 2A:
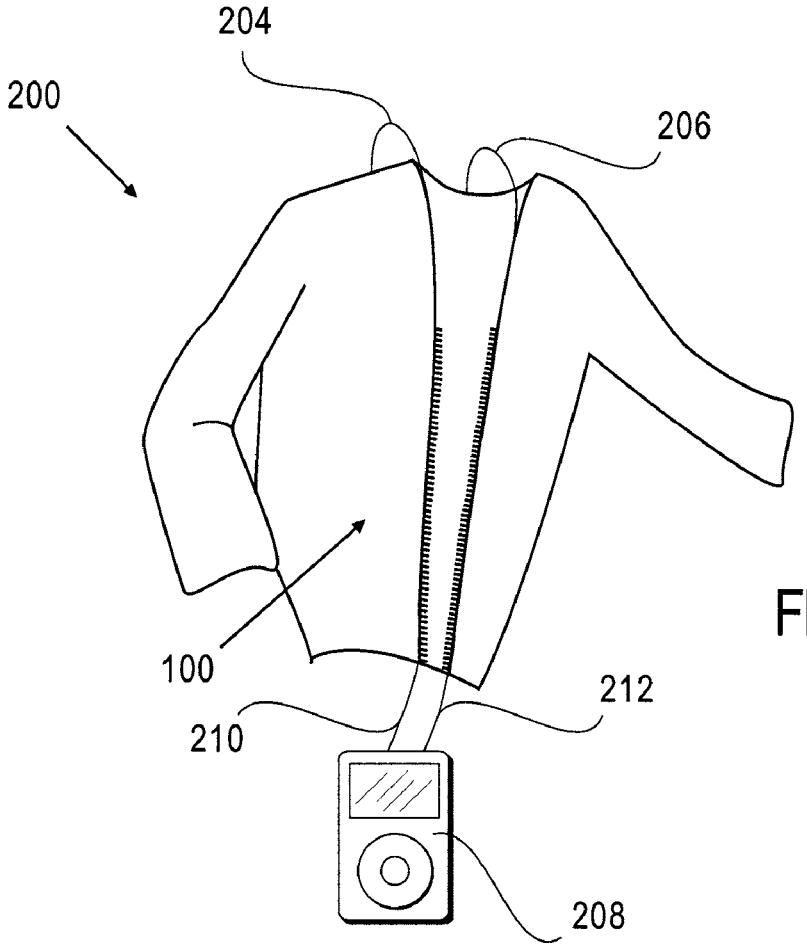
FIGS. 2*a*-2*c* illustrate a garment including a closure arrangement in accordance with various embodiments of the present invention.
Figure 2B:
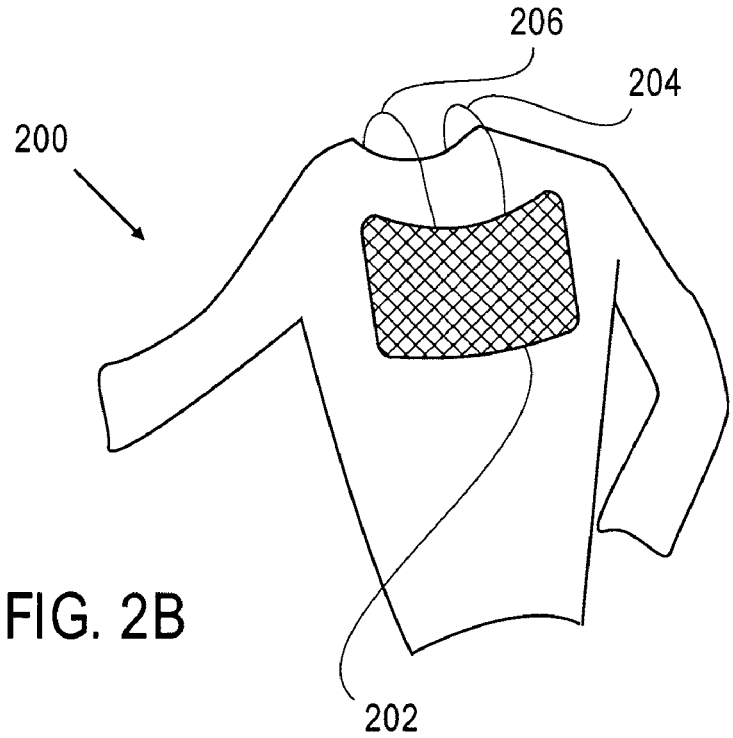
Figure 2C:
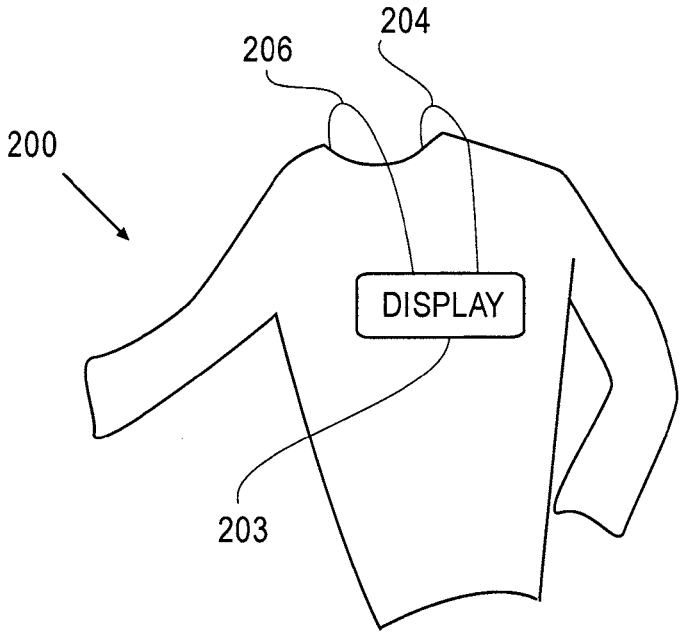
Figure 3:
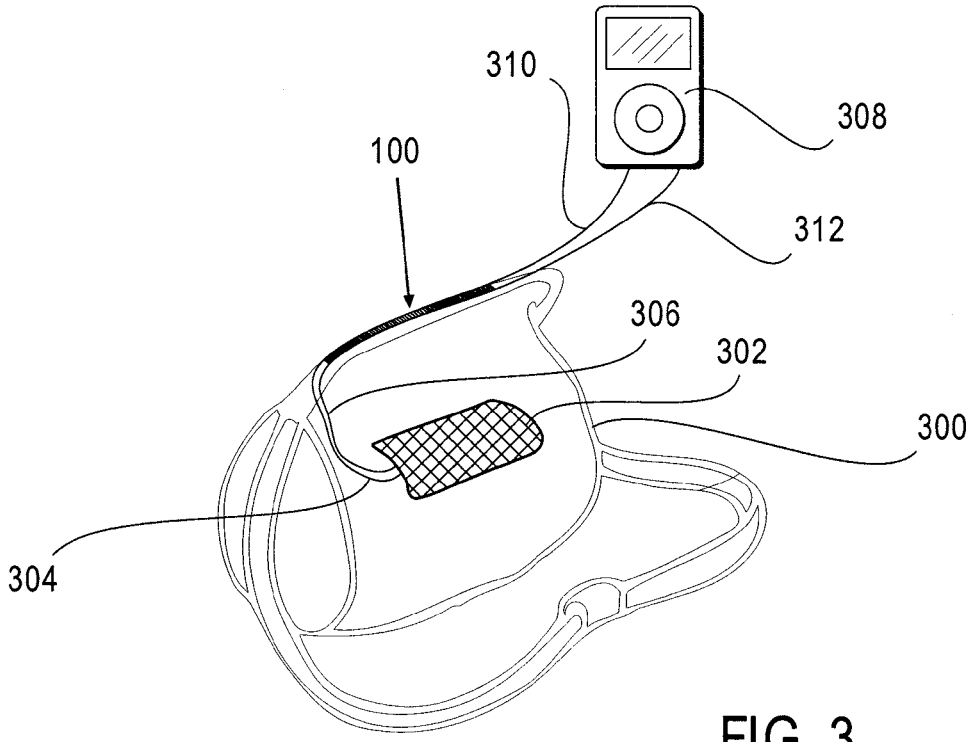
FIG. 3 illustrate a bag including a closure arrangement in accordance with various embodiments of the present invention.

FIGS. 2 and 3 illustrate examples of apparatuses that include a closure arrangement in accordance with various embodiments of the present invention. FIGS. 2*a*, 2*b* and 2*c* illustrate a garment 200 such as, for example, a jacket or sweater that includes a closure arrangement 100. As may be seen in FIG. 2*b*, a flexible solar panel 202 that translates solar light into power may be coupled to the back side (or any other location) of the garment. Conductive conduits 204, 206 may extend from the solar panel and are operatively coupled to the top of closure arrangement 100. A portable electronic device 208 may be operatively coupled to the bottom of closure arrangement 100 via conductive conduits 210, 212. In such a configuration, a solar panel 202 may thus provide power to electronic device 208 via closure arrangement 100.

FIG. 2*c* illustrates the present invention, in accordance with various embodiments, wherein a garment 200 includes a display 203, which may be, for example, a flexible LED or other photon electric type display. As may be seen in FIG. 2*c*, the display 203 may be coupled to the back side (or any other location) of the garment. Conductive conduits 204, 206 may extend from the display and are operatively coupled to the top of closure arrangement 100. A portable power source 208 may be operatively coupled to the bottom of closure arrangement 100 via conductive conduits 210, 212. In such a configuration, a power source 208 may thus provide power to display 203 via closure arrangement 100.

FIG. 3 illustrates a bag 300 such as, for example, a gym bag or backpack that includes a closure arrangement 100. As may be seen in FIG. 3, a flexible solar panel 302 that translates solar light into power may be coupled to a side of the bag. Conductive conduits 304, 306 can extend from the solar panel and be operatively coupled to the top of closure arrangement 100. A portable electronic device 308 may be operatively coupled to the bottom of closure arrangement 100 via conductive conduits 310, 312. Thus, solar panel 302 provides power to electronic device 308 via closure arrangement 100. A display similar to display 203 may be operatively coupled to flexible solar panel 302 via closure arrangement 100, if desired, in place of electronic device 308, or in addition to electronic device 308 via another closure arrangement (not shown) in accordance with various embodiments of the present invention.

Examples of an electronic device 208, 308 include, but are not limited to, audio players, video players, personal digital assistants, cell phones, digital cameras, games, battery chargers, etc.

Figure 4:
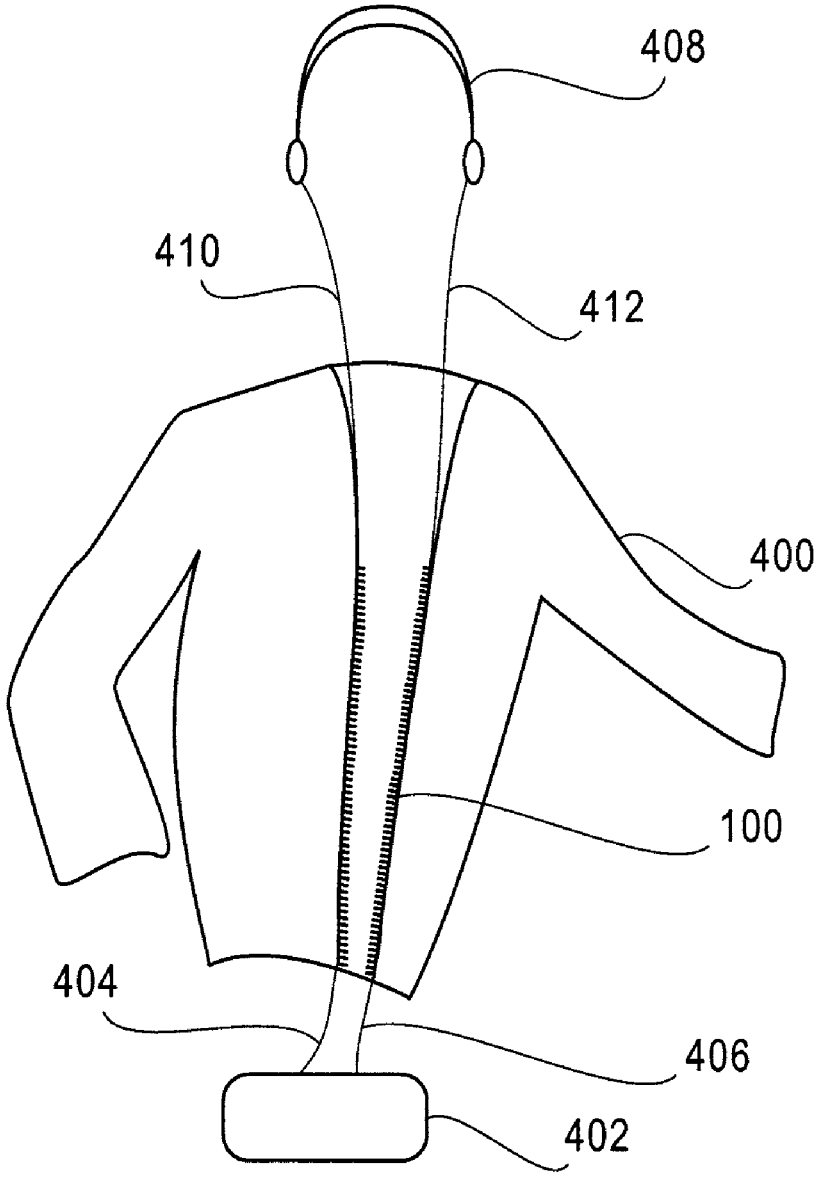
FIG. 4 illustrates another garment including a closure arrangement in accordance with various embodiments of the present invention.

FIG. 4 illustrates a garment 400 such as, for example, a jacket or sweater that includes a closure arrangement 100. A portable electronic device 402 such as, for example, an audio player, a video player, a personal digital assistant, a cell phone, a game, etc. may be operatively coupled to the bottom of closure arrangement 100 via conductive conduits 404, 406. An audio device such as, for example, a headset 408 may be operatively coupled to the top of closure arrangement 100 via conductive conduits 410, 412. Thus, electronic device 402 may provide a signal to audio device 408 via closure arrangement 100.

Although certain embodiments have been illustrated and described herein for purposes of description of the preferred embodiment, it will be appreciated by those of ordinary skill in the art that a wide variety of alternate and/or equivalent embodiments or implementations calculated to achieve the same purposes may be substituted for the embodiments shown and described without departing from the scope of the present invention. Those with skill in the art will readily appreciate that embodiments in accordance with the present invention may be implemented in a very wide variety of ways. This application is intended to cover any adaptations or variations of the embodiments discussed herein. Therefore, it is manifestly intended that embodiments in accordance with the present invention be limited only by the claims and the equivalents thereof.

What is claimed is:

1. A closure arrangement comprising:

a first and second bodies and each of said two bodies providing a cooperative mating structure respectively; and a slider being capable of sliding along said two bodies for coupling or uncoupling said cooperative mating structure;

wherein, the respective body further comprises an internal conductive conduit and an upper stop with an upper connector disposed at an upper end of the respective body for electrically connecting with two first pin connectors disposed at an end of a first pair of external conductive conduits; and a common bottom stop with two lower connectors is joined to a bottom of the respective body for electrically connecting with two second pin connectors disposed at an end of a second pair of external conductive conduits.

2. The arrangement of claim 1, said internal conductive conduit extends along each of said two bodies respectively.

3. The arrangement of claim 1, wherein said two bodies are formed as a zipper, a hook and loop arrangement, a button arrangement, a snap arrangement or a Ziploc-type arrangement.

4. The closure arrangement of claim 1, wherein said upper connector is operatively coupled to said conductive conduit.

5. The closure arrangement of claim 1, wherein said two connectors are operatively coupled to another end of said internal conductive conduit in each of said two bodies respectively.

6. The closure arrangement of claim 1, wherein said internal conductive conduit is a metallic wire covered with an insulation material, a carbon fiber wire, or a fiber optic wire.

7. A system for providing a signal comprising:

a signal-providing device with a first pair of external conductive conduits;

an apparatus;

a signal receiving device with a second pair of external conductive conduits; and a closure arrangement coupled to said apparatus for closing a portion of said apparatus and electrically connecting with said first pair of external conduits and said second pair of external conduits; wherein the closure arrangement further comprises:

a first and second bodies and each of said two bodies providing a cooperative mating structure respectively; and a slider being capable of sliding along said two bodies for coupling or uncoupling said cooperative mating structure;

wherein, the respective body further comprises an internal conductive conduit and an upper stop with an upper connector disposed at an upper end of the respective body for electrically connecting with two first pin connectors disposed at an end of a first pair of external conductive conduits; and a common bottom stop with two lower connectors is joined to a bottom of the respective body for electrically connecting with two pin connectors disposed at a second pair of external conductive conduits.

8. The system of claim 7, wherein said signal receiving device is operatively coupled to the internal conductive conduit.

9. The system of claim 7, wherein the signal receiving device is a display, a battery charger, an audio device or a video device.

10. The system of claim 7, wherein the apparatus is a garment or a bag.

11. The system of claim 7, wherein the signal-providing device is a power source.

12. The system of claim 7, wherein the signal providing device is an audio or video device, and said signal receiving device is a sound producing device.

13. The system of claim 7, wherein said first and second bodies are formed as a zipper, a hooker and loop arrangement, button arrangement, or a Ziploc-type arrangement.

* * * * *